United States Patent [19]

France et al.

[11] 4,205,109

[45] May 27, 1980

[54] FLEXIBLE ANTI-SKID MATERIAL AND METHOD OF MAKING SAME

[76] Inventors: Jerry France, Rte. 2, Box 283, Roswell, N. Mex. 88201; James P. Morgan, Rte. 1, Box 50, Lake Arthur, N. Mex. 88253

[21] Appl. No.: 960,627

[22] Filed: Nov. 14, 1978

[51] Int. Cl.[2] ..... B32B 9/04

[52] U.S. Cl. ..... 428/150; 264/212; 264/213; 264/214; 427/180; 427/204; 428/241; 428/251; 428/285; 428/286; 428/454

[58] Field of Search ..... 428/150, 454, 285, 286, 428/241, 251; 264/544, 556, 212, 213, 214; 427/137, 180, 204

[56] References Cited

U.S. PATENT DOCUMENTS

| | | | |
|---|---|---|---|
| 1,565,122 | 12/1925 | Time | 428/150 |
| 2,175,660 | 10/1939 | Broadwin | 428/150 |
| 3,350,330 | 10/1969 | Cash | 428/150 |

*Primary Examiner*—Marion E. McCamish
*Attorney, Agent, or Firm*—Howard L. Rose

[57] ABSTRACT

A flexible anti-skid material for application to various outdoor and indoor surfaces to produce a long lasting, low-cost, non-skid waterproof surface is formed of a smooth layer of paint adhered to one side of a flexible carrier material and one or more layers of paint each having particles of sand embedded therein adhered to the other side of the flexible carrier material, the anti-skid material being applied to desired surfaces with the use of an adhesive. A method of making the flexible anti-skid material includes coating a hard, smooth substrate with paint, placing a flexible carrier material on the coating of paint, coating the flexible carrier material with paint, distributing sand on the coating of paint, repeating the latter two steps to produce a desired thickness for the anti-skid material, allowing the anti-skid material to dry, and removing the substrate.

15 Claims, 2 Drawing Figures

FLEXIBLE ANTI-SKID MATERIAL AND METHOD OF MAKING SAME

BACKGROUND OF THE INVENTION

1. Field of the Invention

The present invention pertains to anti-skid materials and methods for making the same and, more particularly, to anti-skid materials of a flexible nature to facilitate storage, delivery and application to surfaces of various configurations.

2. DISCUSSION OF THE PRIOR ART

Anti-skid surfaces are desirably utilized in various trafficked areas, such as roadways for vehicles, indoor and outdoor flooring, decks and areas which have a tendency to become wet and slippery, inclines, and in various applications requiring individuals or vehicles to obtain a secure purchase for movement without sliding. In order to alter existing surfaces to have a non-skid nature, it is desirable to produce an anti-skid material that can be securely applied to the existing surfaces; however, in the past, attempts to produce such anti-skid materials for application to existing surfaces have suffered from one or more of the disadvantages of being expensive to produce and install, difficult to transport and apply, and being designed for specific surfaces, such as roadways, and therefore preventing use in other areas, such as for home and commercial indoor and outdoor use.

SUMMARY OF THE INVENTION

Accordingly, it is a primary object of the present invention to overcome the above mentioned disadvantages of the prior art by constructing a flexible anti-skid material which can be easily transported and applied to various trafficked surfaces.

Another object of the present invention is to produce a flexible, long-lasting, low-cost, waterproof, anti-skid material that can be simply applied to trafficked surfaces by means of an adhesive.

Another object of the present invention is to make a flexible, anti-skid material by a method wherein a hard, smooth, preferably highly plasticized, substrate is coated with a flexible epoxy paint, a flexible carrier material such as a sheet or mat of woven or chopped fiberglass, glass or the like is placed on the paint while the paint is still wet, the flexible carrier material is coated with a flexible epoxy paint and sand is distributed on the paint and the above process repeated, until a desired thickness for the anti-skid material is achieved, the anti-skid material is allowed to dry, and the substrate is removed or the material is removed from the substrate.

An additional object of the present invention is to form a flexible anti-skid material for application to trafficked surfaces of a smooth layer of paint adhered to one side of a flexible carrier material, and one or more layers of paint each having particles of sand or the like embedded therein adhered to the other side of the flexible carrier material to produce a desired thickness for the anti-skid material.

Some of the advantages of the present invention over the prior art are that the materials utilized are readily available or quite inexpensive, the anti-skid material is extremely flexible and can be stored and delivered in rolls of various lengths and widths to facilitate application to various trafficked surfaces and can be simply installed by coating a clean wet or dry with a suitable adhesive and rolling the anti-skid material into place. The anti-skid material is waterproof and will not be damaged by mildew, salt water, fresh water and most acids and the anti-skid material can be cleaned simply and easily by using any kind of detergent and washing with water. Further the method of making the anti-skid material is relatively simple and inexpensive to implement.

The present invention is generally characterized in a method of making a flexible anti-skid material including the steps of coating a hard, smooth substrate with paint, placing a flexible carrier material on the coating of paint while the paint is still wet, coating the flexible carrier material with paint, distributing sand on the coating of paint formed in the previous step, allowing the anti-skid material to dry, and removing the substrate. If the initial layer of paint is applied to a surface of Teflon or polyethylene or the like material a separation layer is not required; however, if such is not the case a parting film should be applied to the surface before application of paint.

The present invention is further generally characterized in a flexible anti-skid material for application to trafficked surfaces including a flexible carrier material, a smooth layer of paint adhered to one side of the flexible carrier material, and a layer of paint having particles of sand embedded therein adhered to the other side of the flexible carrier material.

Other objects and advantages of the present invention will become apparent from the following description of the preferred embodiment taken in conjunction with the accompanying drawings.

DESCRIPTION OF THE PREFERRED EMBODIMENT

Figure 1:
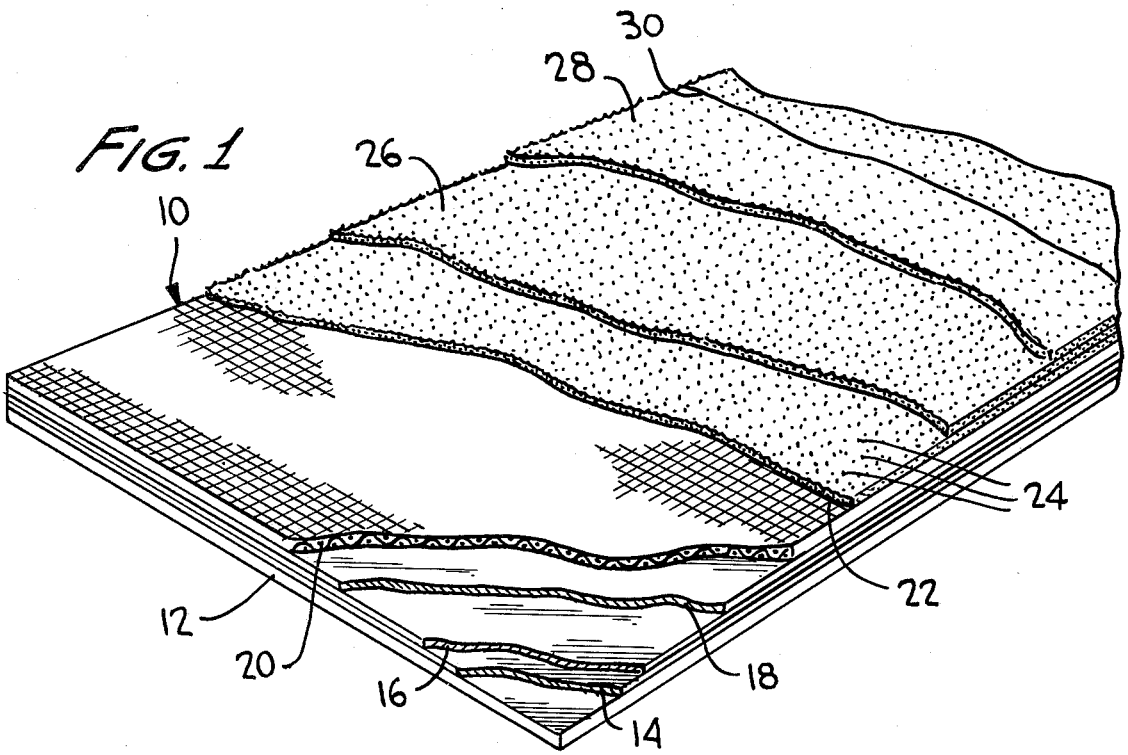
FIG. 1 is a broken perspective view of a flexible anti-skid material formed on a substrate in accordance with the present invention.
Figure 2:
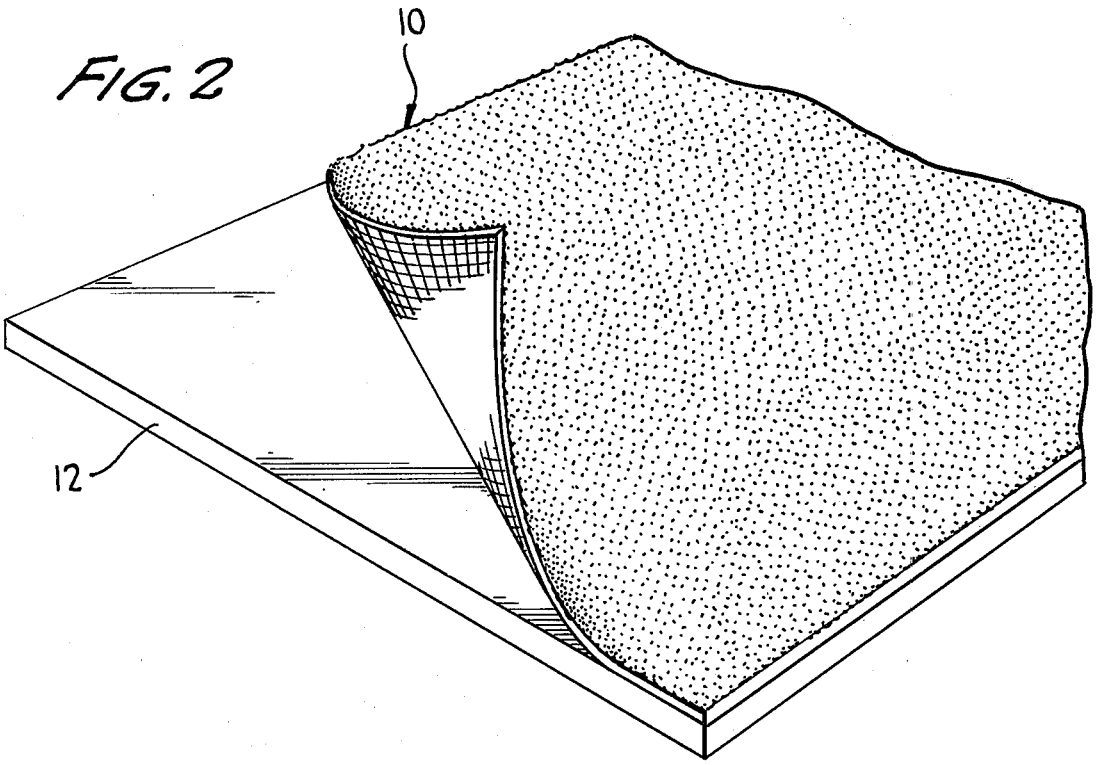
FIG. 2 is a broken perspective view illustrating the removal of the flexible anti-skid material of the present invention from the substrate.

A flexible anti-skid material generally indicated at 10 is illustrated in FIG. 1 formed on a hard, smooth substrate 12 made of any suitable material, such as metal, plastic, or ceramic, and carrying two layers of parting film 14 and 16. The material from which the parting film is made is dependent upon the material from which the substrate 12 is formed and can be any conventional parting film utilized to facilitate stripping or removing of one layer from another. The parting layer is not required on a Teflon or like surface.

The flexible anti-skid material 10 is composed of a smooth layer of flexible, preferably epoxy, paint 18 coated on the parting film 16 and adhering to a sheet of flexible carrier material 20 made of a suitable flexible nonbrittle material such as a sheet or mat of woven or chopped fiberglass or simply chopped glass. A layer of paint 22 adheres to the other side of the flexible carrier material 20 and particles of sand 24 are embedded in the layer of paint 22. On top of the layer of paint 22 with sand 24 embedded therein, are additional layers of sand-embedded paint 26 and 28, the number of layers of sand-embedded paint being determined by the ultimate thickness desired for the flexible anti-skid material. A layer of paint is coated on the top layer of sand embedded paint 28, the layer of paint 30 and desirably the layers of paint 18, 22, 26 and 28 having a color corresponding to the ultimate use of the flexible, anti-skid material.

The layers of paint 18, 22, 26, 28 and 30 are preferably formed of a flexible epoxy paint composed entirely or substantially entirely of solid material in order to minimize shrinkage upon drying, and the paint is preferably waterproof to protect surfaces upon which the flexible anti-skid material is applied. An example of such a paint is Bradco EPO 763.

In accordance with the present invention a method of making the flexible anti-skid material 10 includes waxing the surface of the substrate 12 several times to produce a smooth finish, applying, normally by spraying, parting film 14 to the prepared surface of substrate 12 and permitting the parting film 14 to dry before applying the second layer of parting film 16 and permitting it to dry. The layer of paint 18 is then coated on the parting film 16; and, while the layer of paint 18 is still wet, the flexible carrier material 20 is placed on the paint. The flexible carrier material is then coated with the layer of paint 22 and particles of sand 24 are distributed on the wet layer of paint 22, the last two steps of coating with paint and distributing sand on the paint being repeated in sequence to produce the desired thickness for the flexible anti-skid material 10. Once the desired thickness is achieved the final layer of paint 30 is applied; and, thereafter, the anti-skid material is removed from the substrate, the back surface of the anti-skid material can be washed to remove all of the parting film using soap and water and just clear water.

Due to the flexible qualities of the paint and the flexible carrier material, the anti-skid material 10 is sufficiently flexible to be rolled up for easy shipping storage and application to desired trafficked surfaces. To apply the flexible anti-skid material to trafficked surfaces, the surface is thoroughly cleaned and a coating of adhesive is sprayed, rolled, brushed or otherwise applied to the clean trafficked surface. Thereafter, the flexible anti-skid material 10 can be simply rolled into place and will be securely held in place by the adhesive. An example of an adhesive useful in securing the flexible anti-skid material 10 in place is Bradco Plastics EPS 704.

The flexible anti-skid material 10 produced in accordance with the method of the present invention provides a long lasting, waterproof surface for trafficked areas and can be utilized for both indoor and outdoor applications having various configurations. If desired the flexible anti-skid material can have the back surface thereof i.e. layer of paint 18, provided with a layer of adhesive covered with a suitable release paper to avoid the necessity of separately spreading an adhesive for securing the anti-skid material in place.

Inasmuch as the present invention is subject to many variations, modifications and changes in detail which are specifically illustrated and described may be restored to without departing from the true spirit and scope of the invention as defined in the appended claims.

What I claim is:

1. A method of making a flexible anti-skid material comprising the steps of:

(a) coating a hard, smooth substrate with paint;
(b) placing a flexible carrier material on the coating of paint while the paint is still wet;
(c) coating the flexible carrier material with paint;
(d) distributing sand on the coating of paint formed in step (c);
(e) allowing the anti-skid material to dry; and
(f) removing the substrate.

2. The method as recited in claim 1 wherein said coating step (c) and said distributing step (d) are repeated in sequence to produce a desired thickness for the anti-skid material.

3. The method as recited in claim 1 wherein the flexible carrier material is formed of fiberglass.

4. The method as recited in claim 3 wherein the flexible carrier material is a sheet of woven fiberglass.

5. The method as recited in claim 3 wherein the flexible carrier material is a mat of chopped fiberglass.

6. The method as recited in claim 1 and further comprising the step of applying parting film to the substrate prior to said coating step (a).

7. The method as recited in claim 6 and further comprising the step of waxing the substrate prior to said step of applying parting film to the substrate.

8. The method as recited in claim 7 and further comprising the step of removing the parting film from the non-skid material after said removing step (e).

9. The method as recited in claim 8 wherein the substrate is made of plastic.

10. The method as recited in claim 1 wherein the paint used in said coating steps (a) and (c) is an epoxy paint composed substantially entirely of solid material.

11. A flexible, anti-skid material for application to trafficked surfaces comprising a flexible carrier material;
a smooth layer of paint adhered to one side of said flexible carrier material; and
a layer of paint having particles of sand embedded therein adhered to the other side of said flexible carrier material.

12. The flexible, anti-skid material as recited in claim 11 wherein said flexible carrier material is formed of a woven sheet of fiberglass.

13. The flexible, anti-skid material as recited in claim 11 wherein said flexible carrier material is formed of a mat of chopped fiberglass.

14. The flexible, anti-skid material as recited in claim 11 wherein said paint forming said smooth layer and said sand-embedded layer is an epoxy paint composed substantially entirely of solid material.

15. The flexible, anti-skid material as recited in claim 14 and further comprising additional layers of paint having particles of sand embedded therein disposed on said first-mentioned, sand-embedded layer of paint.

* * * * *